United States Patent [19]

Palchetti et al.

[11] Patent Number: 4,744,822

[45] Date of Patent: May 17, 1988

[54] PROCESS FOR CONTINUOUS PURIFICATION OF HOT METAL

[75] Inventors: Maurizio Palchetti; Santi Palella; Adolfo Crisafulli, all of Rome, Italy

[73] Assignee: Centro Sviluppo Materiali S.p.A., Rome, Italy

[21] Appl. No.: 937,363

[22] Filed: Dec. 3, 1986

[30] Foreign Application Priority Data

Dec. 3, 1985 [IT] Italy ..... 48864 A/85

[51] Int. Cl.[4] ..... C21C 7/02

[52] U.S. Cl. ..... 75/57; 75/58

[58] Field of Search ..... 75/57, 58

[56] References Cited

U.S. PATENT DOCUMENTS 3,998,625 12/1976 Koros ..... 75/58

*Primary Examiner*—Peter D. Rosenberg

*Attorney, Agent, or Firm*—Young & Thompson

[57] ABSTRACT

A process for the continuous treatment of hot metal as it is running from the blast furnace, in order to enable low phosphorus and sulphur levels to be attained simply and cheaply, so that the metal thus treated is suitable for subsequent use in the convertor for the preparation of steels with a low and very low impurities content. Desulphurizing agent is added to the hot metal flowing in a trough into which it falls from the iron notch of a blast furnace, at a point close to that falling stream of hot metal. The silicon level is measured; and when it exceeds 0.25%, a silicon reduction agent is subsequently added to the hot metal in the trough. Finally, a phosphorus reduction agent is added to the hot metal as it leaves the trough and falls into a receptacle such as a torpedo car. Slag can be skimmed following sulphur and silicon treatments. The order of addition of the silicon reducing agent and sulphur reducing agent can be reversed.

6 Claims, 1 Drawing Sheet

PROCESS FOR CONTINUOUS PURIFICATION OF HOT METAL

Figure 1:
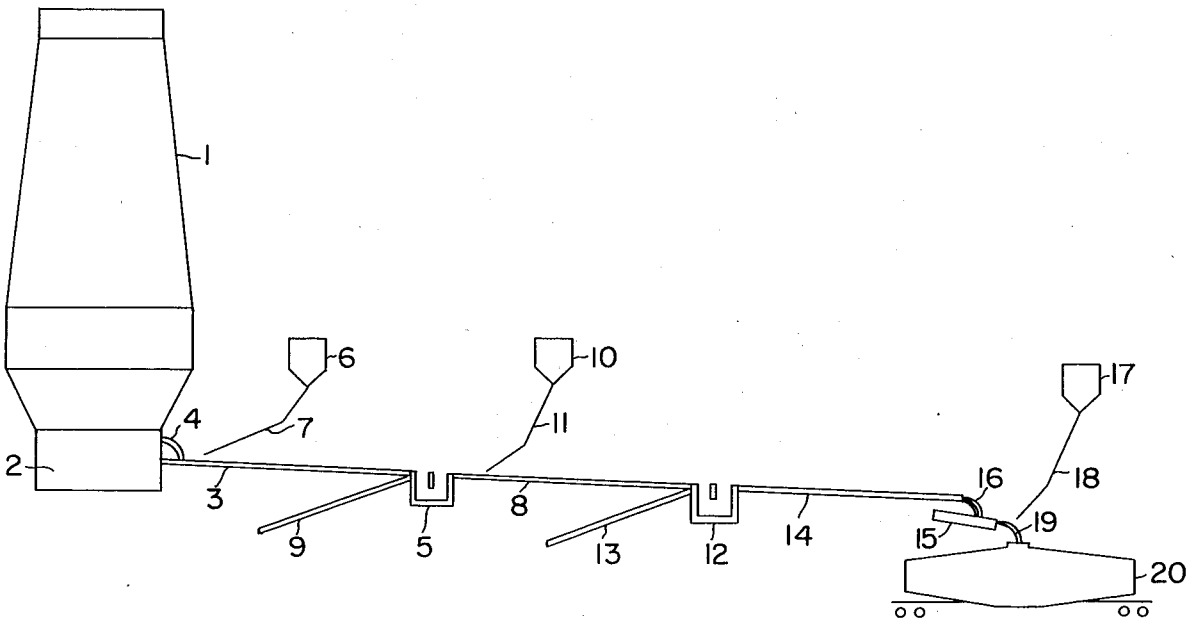

This invention concerns a process for the continuous purification of hot metal. More precisely it concerns methods of obtaining very low phosphorous and sulphur contents while the hot metal is being transferred from the blast furnace to the torpedo car.

Modern technology, of course, cells for steels that are custom-made for given applications, and especially for steels with a low or very low impurities content, particularly phosphorus and sulphur.

However, the supplying of iron ore and fossil fuels low in such undesirable elements is likely to become increasingly difficult, while the converter (i.e. LD or BOF furnace) is more and more coming to have the role of a reactor—essentially for decarburization—that must operate under standardized conditions.

It is evident, therefore, that the hot metal, which is the main item in the converter charge, must have a tightly controlled analysis and that phosphorus and sulphur contents especially must be below given, specific limits.

Though hot-metal purification operations are thus highly desirable, they must not be particularly costly, and preferably should not interfere with the time schedule of operations between hot-metal tapping from the blast furnace and converter charging. This feature will be even more desirable in the future because when new plants are built and old ones revamped, the tendency is to have the steel shop ever closer to the blast furnace, so as to eliminate torpedo cars, hence enabling the hot metal to be run directly into the ladle.

These requirements and trends mean that traditional processes and even those now in the experimental stage or installed in a few works, based on torpedo-car treatment of hot metal, will become difficult to apply in the future. Moreover, they are costly in themselves and expensive as regards operation of the whole area in general. In fact, present hot metal treatment processes provide for batchwise dephosphorization and desulphurization in the torpedo car or, in some cases, in specially equipped converters.

However, such treatments are quite costly. For instance, dephosphorization in the torpedo car at the present time involves injection of the reduction agent under a considerable head of molten metal, so a treatment plant is needed that can operate at high pressures (around 10 atmospheres) and this causes abundant foaming of the slag; hence the torpedo cars can only be partly filled. In any case, it is impossible to avoid some spillover of slag, even though this may not be great. Means must thus be provided to collect and dispose of the slag spills, while torpedo car servicing times are considerably longer owing to the need to clean the mouth. The number of torpedo cars must therefore be increased, but this cannot be done in many works owing to the size of the rail network.

The present invention is designed to overcome these drawbacks, the continuous hot metal purification process involved being simple and cheap, while not requiring any further treatment or processing. The invention stems from the observation that though hot metal flows down the main trough from the blast furnace fairly slowly and without much turbulence, the fall from the iron notch into the trough and then from there into the torpedo car causes mixing that can be used to ensure intimate contact with an addition agent. Moreover, the hot metal remains long enough in the trough to guarantee that the ensuing reactions proceed a good way towards completion. However, the addition agents must be fed stepwise and in a certain order so as to obtain good results and high yields.

For instance, the dephosphorization reaction does not occur if there is more than 0.25% silicon, by weight, in the hot metal, so silicon must be reduced before dephosphorizing. However, the reduction in silicon causes a change in the composition of the slag floating on the metal, with the result that part of the sulphur in the slag is transferred to the hot metal.

The sequence of operations must thus be optimized to ensure efficient, economically attractive treatment. The invention is characterized, therefore, by the combination of the following operations performed sequentially:

(a) measurement of silicon, sulphur and phosphorus contents—by known methods—of the hot metal as it is tapped from the blast furnace;

(b) addition of a sulphur reduction agent to the hot metal flowing in the main trough preferably as close as possible to the stream leaving the iron notch;

(c) separation of slag from the hot metal;

(d) addition of a silicon reduction agent to the slag-free hot metal, when the silicon content is greater than 0.25%;

(e) separation of the new slag from the hot metal;

(f) addition of a phosphorus reduction agent to the hot metal as it falls into the torpedo car.

The agents adopted to reduce the sulphur, silicon and phosphorus contents are fed continuously, of course, during the whole tapping operation, the quantities used being in keeping with the effect it is wished to obtain. The addition agents are preferably as follows:

for sulphur reduction: calcium oxide, between 60 and 90% by weight, the remainder being essentially calcium carbonate; the quantity used ranges from 4 to 15 kg/t HM;

for silicon reduction: iron oxides, between 80 and 100 percent by weight, the remainder being essentially calcium oxide; the quantity used ranges from 10 to 50 kg/t HM;

for phosphorus reduction: iron oxides, between 40 and 70%, calcium oxide between 30 and 60% and calcium fluoride or chloride up to 20% by weight; the quantity used on the hot metal falling into the torpedo car ranges from 30 to 70 kg/t HM.

As already mentioned, the quantities of addition agents needed for each reaction are calculated basically as a function of the quantity of element to be eliminated and, subordinately, as a function also of general plant characteristics that influence turbulence of the hot metal, such as, for instance, the height the hot metal falls, trough and runner cross-sections, etc.

The quantity of addition agent can, of course, be calculated on a once-and-for-all basis. However, in this case an excess must be used so as to ensure that the reaction will always be more or less complete, otherwise it will not be possible to count on hot metal of constant composition.

The order of the sulphur and silicon reduction operations can be reversed. In this case, however, the consumption of desulphurizing agent will increase owing to the resulphurizing effect of the silicon reduction operation described above, but there is the great advantage of eliminating a deslagging operation and of better removal of the fumes given off during silicon reduction.

The addition agents can be allowed to fall simply into the hot metal from feed screws, feed belts and the like. However, it has been noted that owing to the particle size and moisture content of the agents, feeders which operate essentially by gravity may block up or at least not feed the agent regularly. Consequently, it is as well to use pneumatic feeders.

This is important especially for the addition of agents following the first deslagging, because the hot metal in the trough downstream of that point moves quite slowly, so the agent could just remain on the surface if it were merely allowed to fall in freely. A device which ensures that the agent penetrates some way into the hot metal is certainly preferable, greatly improving the efficiency of the reaction.

The process for the continuous treatment of hot metal as per this invention is therefore very simple. It utilizes technical devices that are also simple and cheap, permitting treatment to be performed without any operations that are difficult to execute or which interfere with the general running of the works.

The invention will now be described in greater detail by reference to an embodiment which is given purely for the purpose of exemplification and is in no way limiting as regards the invention and claims thereto. The explanation is facilitated by reference to the accompanying schematic diagram of a possible plant.

Hot metal trapped from the hearth 2 of blast furnace 1 falls as a stream 4 into main trough 3, which is broad, deep, relatively short and slopes slightly downwards from an iron notch to terminate in a slag skimmer or pocket 5, to remove slag from the metal. The slag is carried away from pocket 5 by runner 9, while the hot metal proceeds down through 8 which has a smaller cross-section than main trough 3. A quantity of addition agent is fed from bin 6 via conveyance device 7 into main trough 3 as close as possible to stream 4. In this way the mixing effect caused by the fall of the hot metal into the trough ensures excellent distribution. The addition agent at this stage is desulphurizing. The products of reaction are absorbed in the slag and are thus stripped from the hot metal in pocket 5 and removed via runner 9. The silicon reduction agent in bin 10 is fed into trough 8 via feeding device 11 which should preferably be pneumatic to favour good mixing with the hot metal. The reaction produces new slag which is separated in pocket 12 and eliminated via runner 13. The hot metal than proceeds down through 14 and falls as a stream 16 into a swivel device 15 whence it falls as stream 19 into torpedo car 20. The phosphorus reduction agent contained in bin 17 is fed by device 18 into stream 19.

In the trials performed, one of the iron notches of a blast furnace producing 9400 t HM/day was equipped as indicated in the sketch. It should be observed that the hot metal is tapped more or less continuously from the blast furnace used in the trials, so there were no great variations in composition during tapping operations from a single iron notch.

In practice, the composition of the hot metal is determined at the start of the tapping and, consequently, the amount of addition agents needed is established.

In one of the trials the hot metal impurities, expressed as percentage by weight, were as follows: S between 0.021 and 0.027, Si between 0.46 and 0.20, and P between 0.075 and 0.065. The following tables indicate the average reductions in impurities attained with different quantities of addition agents.

TABLE 1

| | Amount of sulphur reduction agent (kg/t HM) | | |
|---|---|---|---|
| | 4.5 | 5.5 | 10 |
| ΔS | 0.017 | 0.020 | 0.023 |

TABLE 2

| | Amount of silicon reduction agent (kg/t HM) | | |
|---|---|---|---|
| | 14 | 24 | 44 |
| ΔSi | 0.11 | 0.14 | 0.18 |

TABLE 3

| | Amount of phosphorus reduction agent (kg/t HM) | | | |
|---|---|---|---|---|
| | 35 | 45 | 55 | 65 |
| ΔP | 0.028 | 0.033 | 0.045 | 0.053 |

In detail, hot metal containing the following impurities, expressed as percentage by weight—S, 0.027, Si, 0.23 and P, 0.068—was treated with 5 kg sulphur reduction agent, 24 kg silicon reduction agent and 55 kg phosphorus reduction agent per ton of hot metal. The final contents were S, 0.008, Si, 0.05 and P, 0.026, again expressed as percentage by weight.

At the entrance to the steel shop the phosphorus content of the hot metal had further decreased to 0.023%. The yield of the addition agents, expressed as (initial percentage of element-final percentage of element) (kg agent/t hot metal) ranged between $2\times10^{-3}$ and $5\times10^{-3}$ for sulphur, between $1\times10^{-2}$ and $5\times10^{-3}$ for silicon and between $1\times10^{-3}$ and $8\times10^{-4}$ for phosphorus.

It is evident that the method and materials used are extremely simple and efficient, with costs much lower than before. In particular, the materials employed, which are of course known for such uses, are very economical and readily available in a steel-works; for instance, the iron oxides can consist of mill scale, red converter fumes or similar waste or salvaged materials.

We claim:

1. Continuous process for purification of hot metal containing silicon, sulphur and phosphorus tapped from a blast furnace through an iron notch into a trough and thence into a receptacle, comprising the following steps:

measuring at least the silicon content of the hot metal as it is tapped from the blast furnace;

adding sulfur reduction agent to the hot metal flowing in the trough close to the iron notch;

deslagging the hot metal;

adding silicon reduction agent to the hot metal when the silicon exceeds 0.25%; and adding phosphorus reduction agent to the hot metal entering the receptacle.

2. Process as in claim 1, in which the addition of sulphur, silicon and phosphorus reduction agents is performed continuously during the whole tapping operation.

3. Process as in claim 1, in which the addition agent for sulphur reduction comprises calcium oxide in amounts ranging between 60 and 90% (by weight) balance essentially calcium carbonate, the amount of such agent fed to the hot metal ranging between 4 and 15 kg/t HM.

4. Process as in claim 1, in which the addition agent for silicon reduction comprises iron oxide in amounts ranging between 80 and 100% (by weight) balance essentially calcium oxide, the amount of such agent fed to the hot metal being between 10 and 50 kg/t HM.

5. Process as in claim 1, in which the addition agent for phosphorus reduction comprises iron oxides in amounts ranging between 40 and 70% (by weight), calcium oxide in amounts ranging between 30 and 60% (by weight) and calcium fluoride and chloride in amounts up to 20% (by weight), the amount fed to the hot metal being between 30 and 70 kg/t HM.

6. Continuous process for purification of hot metal containing silicon, sulphur and phosphorus tapped from a blast furnace through an iron notch into a trough and thence into a receptacle, comprising the following steps:

measuring at least the silicon content of the hot metal as it is tapped from the blast furnace;

adding silicon reduction agent to the hot metal flowing in the trough close to the notch, when the silicon content exceeds 0.25%;

thereafter adding to the hot metal flowing in the trough, at a point spaced from the point of addition of silicon reduction agent, sulphur reduction agent; and adding phosphorus reduction agent to the hot metal entering the receptacle.

* * * * *